United States Patent [19]

Kuhn

[11] Patent Number: 4,618,105

[45] Date of Patent: Oct. 21, 1986

[54] ROLLER WINDING MACHINE ATTACHING AND SERVING APPARATUS

[75] Inventor: Friedrich Kuhn, Heidenheim, Fed. Rep. of Germany

[73] Assignee: J. M. Voith GmbH, Heidenheim, Fed. Rep. of Germany

[21] Appl. No.: 637,437

[22] Filed: Aug. 3, 1984

[30] Foreign Application Priority Data

Aug. 6, 1983 [DE] Fed. Rep. of Germany ..... 3328516

[51] Int. Cl.[4] ..... B65H 18/20; B65H 19/26; B65H 19/28

[52] U.S. Cl. ..... 242/56 R; 242/66

[58] Field of Search ..... 242/56 R, 56 B, 56.6, 242/56.8, 66; 156/353–355, 502–506

[56] References Cited

U.S. PATENT DOCUMENTS

| | | | |
|---|---|---|---|
| 3,869,095 | 3/1975 | Diltz | 242/56 R |
| 3,918,654 | 11/1975 | Okobo et al. | 242/56 R |
| 4,345,722 | 8/1982 | Kuhn | 242/56 R |
| 4,444,360 | 4/1984 | Kaipf et al. | 242/56 R |

FOREIGN PATENT DOCUMENTS

| | | | |
|---|---|---|---|
| 2709684 | 9/1977 | Fed. Rep. of Germany | 242/56 R |

*Primary Examiner*—John M. Jillions

*Attorney, Agent, or Firm*—Grimes & Battersby

[57] ABSTRACT

A double support roller winding machine for winding material webs onto core tubes with different diameters includes an attaching and severing device mounted so that it can be swung from above down into the roller bed where a new core tube has been inserted to engage the new core tube at its apex, to attach the web to the new core tube and to sever the fully wound roll which has been ejected from the roller bed from the attached web start.

3 Claims, 2 Drawing Figures

ROLLER WINDING MACHINE ATTACHING AND SERVING APPARATUS

BACKGROUND OF THE INVENTION

The present invention relates generally to a double support roller winding machine for winding material webs such as paper or board webs onto core tubes with different diameters.

More particularly, the present invention relates to an apparatus in a double support roller winding machine for attaching material webs to core tubes around which the webs are to be wrapped and for severing the webs from previously wrapped tubes.

A prior art double support roller winding machine of the same general description is disclosed in German Offenlegungsschrift No. 31 51 256. The attaching and severing device used in that machine is mounted so that it can be moved transversely to the axis of the supporting rollers on a slideway connected to lever arms. After a fully wound tube has been pushed out of the roller bed defined by the supporting rollers, the slideway is swung into the central plane of the winding machine above the supporting rollers. According to the diameter of the next core tube which is to be wrapped, the device is then moved along the slideway down more or less deeply into the roller bed from an initial upper position, until the device has been set on the apex of the next core tube around which the web of material is to be wrapped. The web is then fixed to this next core tube and the fully wound roll is severed from the attached web start. Although with this known machine the attaching and severing device always acts on the apex of the core tube, whatever the size of the core tube being used, the slideway structure and the motorised drive for the device on this slideway are extremely complex and expensive.

OBJECTS OF THE INVENTION

Against the foregoing background, it is a primary object tof this invention to provide a new and improved, simple, uncomplicated and relatively inexpensive apparatus for attaching and severing material webs in a double support roller winding machine.

It is a further object of this invention to provide an attaching and severing apparatus in a double support roller winding machine which is mounted so that the attaching and severing of the web is effected in the vicinity of the apex of the tube which is to be wrapped next.

It is an additional object of this invention to provide an attaching and severing apparatus in a double support roller winding machine which is mounted so that the attaching and severing of the web is effected in the vicinity of the apex of the tube which is to be wrapped next irrespective of the diameters of the various core tubes being wrapped.

It is still a further object of this invention to provide an attaching and severing apparatus which attaches and severs the web exactly on the apex of the core tube when two different most often utilized core tube sizes are wrapped.

SUMMARY OF THE INVENTION

The accomplishment of the foregoing objects is achieved by a double support roller winding machine with an attaching and severing apparatus which is mounted on lever arms so that it can be swung from a rest position, above the roller bed formed by the support rollers, to a work position, where it first engages a new core tube inserted into the roller bed and around which the web has been partially wrapped, then attaches the web to the new core tube, and finally severs the web from the fully wound roll which had been previously ejected from the roller bed. The pivot axis of the lever arms lies at a distance from and parallel to the axes of rotation of the support rollers. The pivot axis of the lever arms further lies in a plane which extends parallel to the plane defined by the axes of the supporting rollers and which passes through a point that is at least approximately halfway between the positions of the apexes of the core tubes of the largest and smallest diameter core tubes that can be handled. In this manner, the path of travel of the attaching and severing apparatus about the pivot axis of the lever arms passes approximately through the apexes of core tubes of any diameters laid in the roller bed. In a preferred embodiment, the effective length of the lever arms is between 0.5 times and 3 times the distance between the axes of the supporting rollers.

BRIEF DESCRIPTION OF THE DRAWING

The foregoing and still other objects, advantages and novel features of the present invention will be more fully appreciated from the following further detailed explanation of the invention with reference to the accompanying drawing wherein.

DETAILED DESCRIPTION OF A PREFERRED EMBODIMENT

Figure 1:
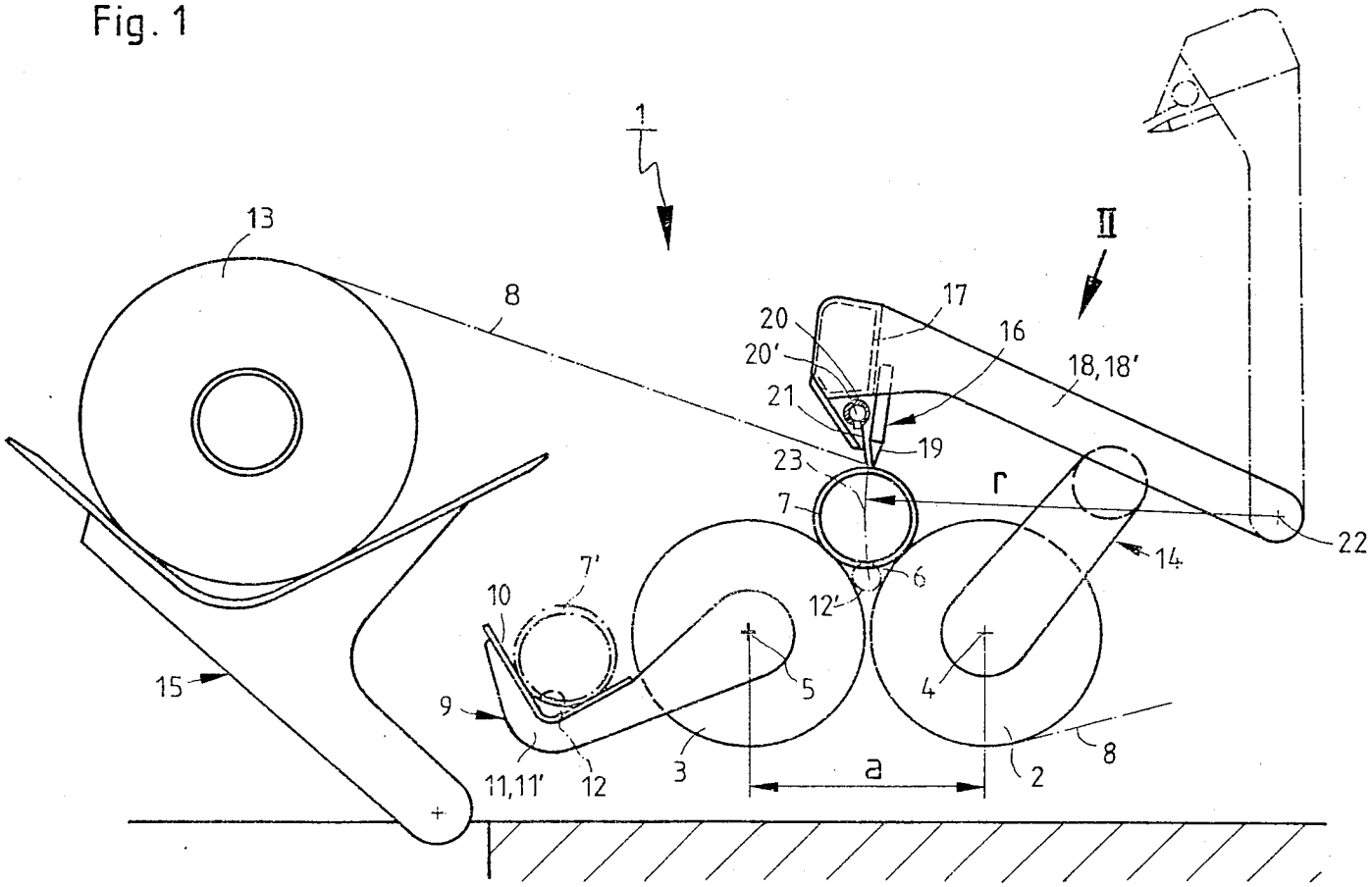
FIG. 1 is a schematic, front view of a double support roller winding machine according to this invention.
Figure 2:
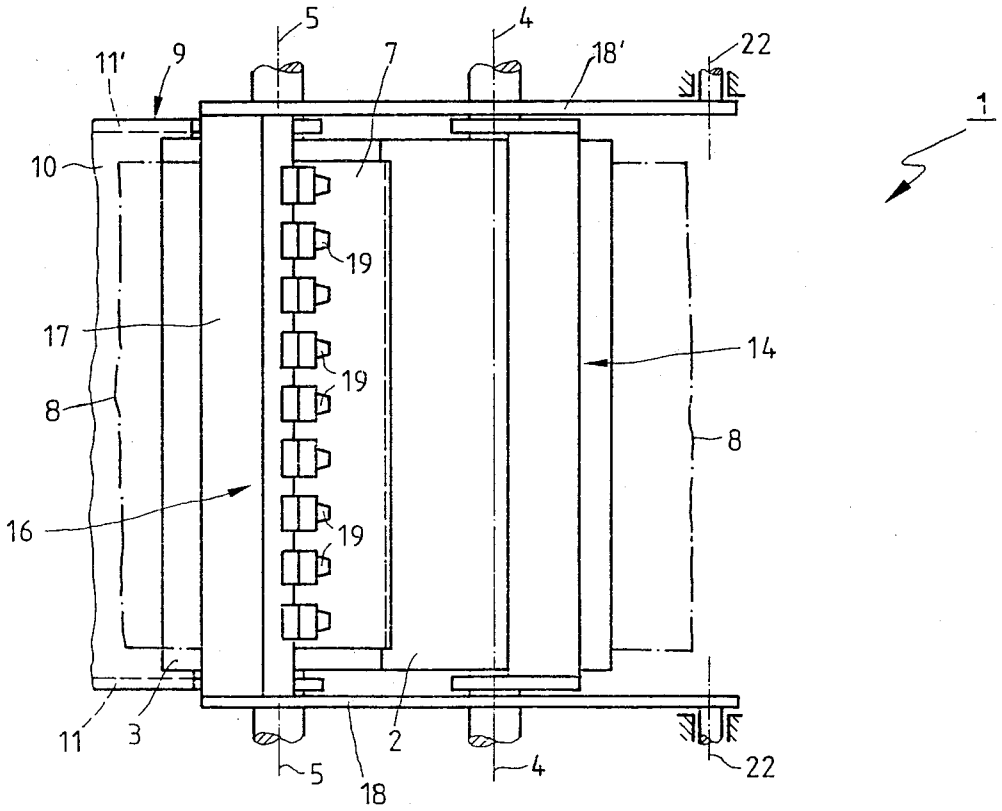
FIG. 2 is a view looking in the direction of arrow II of FIG. 1.

FIG. 1 discloses a preferred embodiment of a winding machine 1 according to this invention. The winding machine 1 has two rotatably driven supporting rollers 2 and 3, which are mounted in the machine frame (not shown) with their axes of rotation 4 and 5 spaced apart by the distance "a". The supporting rollers 2 and 3 form a roller bed 6 above the common plane of their axes of rotation 3 and 4, in which a core tube 7 can rest. A material web 8, for example a board web, passes around the supporting roller 2 and is wound onto core tube 7 when the supporting rollers 2 and 3 are rotated.

For inserting a new core tube 7,7' at the start of a winding cycle, a core tube insertion device 9 is provided. This has an insertion trough 10 which is mounted on rocking levers 11,11' and which extends approximately coaxially with the axis of rotation 5 of the supporting roller 3 around which the web is not wrapped. Core tubes of different diameters can be laid in the roller bed 6 by means of insertion device 9. Core tubes 7,7' with large diameters are used mainly for winding boards which are resistant to bending, while core tubes 12,12' with smaller diameters are used for webs with less weight per unit area.

Before new core tubes 7,7' can be laid in the roller bed 6, it is necessary for the fully wound roll 13 to be ejected from the roller bed. For this purpose the winding machine 1 has an ejection device 14 mounted so that it can pivot around the axis of rotation 4 of the supporting roller 2 around which the web is wrapped. The device 14 pushes the fully wound roll 13 over the supporting roller 3 around which the web is not wrapped, away onto a delivery table 15 which has been swung towards roller 3. After the fully wound roll 13 has been passed from the supporting roller 3 onto the delivery table 15, the latter is swung into an intermediate position, as shown in FIG. 1. In this position, the core tube insertion device 9 is able to lay the new core tube 7,7' in the roller bed 6. The material web 8 which is drawn along behind the fully wound roll 13 when it is being ejected is thereby wound around the greater part of the circumference of the newly inserted core tube 7,7'.

The winding machine 1 has an attaching and severing apparatus 16 which is swung out of its rest position shown in broken lines in FIG. 1 into its working position shown with fully drawn lines in FIG. 1, after a new core tube 7,7' has been inserted in the roller bed 6. The attaching and severing apparatus 16 has a torsion-resistant girder 17 which is connected at its two ends to lever arms 18. In its working position, the attaching and severing apparatus 16 engages the core tube 7 laid in the roller bed 6 at the apex of the tube. A plurality of attaching mechanisms 19 are provided along the girder 17, spaced apart from each other, for attaching the web 8 to the new core tube 7. This enables staples or nails to be driven through the web 8 into the core tube 7. The girder 17 also has a servomotor 20 without a piston rod and having a blade 21 attached to its piston 20'. This blade 21 is drawn through the web 8 by the servomotor 20 in order to sever the fully wound roll 13 from the web start attached to the new core tube 7. Thereafter the wound roll 13 is conveyed out of the winding machine 1 by lowering the delivery table 15, and the attaching and severing apparatus 16 is returned to its rest position.

The pivot axis 22 for the lever arms 18 extends parallel to the axes of rotation 4 and 5 of the supporting rollers 2 and 3 and is positioned at a distance from the supporting roller 2 around which the web is wrapped so that the attaching and severing apparatus 16 will engage each newly inserted tube in the roller bed in the vicinity of its apex, irrespective of whether the tube has a larger size diameter like tubes 7,7' or a smaller size diameter like tubes 12,12' which lie deep down in the roller bed 6. The effective length "r" of the lever arms 18 in the embodiment shown amounts to approximately twice the distance "a" between the axes of the supporting rollers 2 and 3. Preferably, the effective length "r" of the lever arms is between 0.5 and 3 times the distance "a" between the axes of the supporting rollers 2 and 3.

Moreover, the pivot axis 22 of the lever arms 18,18' lies in a plane which extends parallel to the common axial plane of the supporting rollers 2 and 3 and through a point halfway between the apexes of the core tubes 7,7' and 12,12', which are the largest and smallest size diameter core tubes that will be handled. With this arrangement, the engagement point of the attaching and severing apparatus 16 approximately coincides with the curve defined by a plot of the apexes of the various sizes of core tubes with diameters between the above-mentioned core tube sizes which may be inserted in the roller bed 6. The path 23 of the engagement point of the attaching and severing apparatus 16 in the roller bed 6 is shown in the drawing with a broken line for clearness.

Although the foregoing illustrates certain specific elements of the present invention, it will be appreciated that the teaching of this application encompasses broader and different combinations than that specifically recited herein. Accordingly, the present invention should be limited only by the true scope and range of equivalence of the appended claims.

I claim:

1. A double support roller winding machine for winding material webs onto core tubes with different diameters to form wound rolls, said machine having at least two support rollers, a roller bed defined by said support rollers, loading means for inserting core tubes into said roller bed and unloading means for removing wound rolls from said roller bed, wherein the improvement comprises an attaching and severing means mounted for pivotal movement about a first axis from a rest position above said roller bed to a work position in engagement with the apex of the core tube in said roller bed, said attaching and severing means comprising means for attaching the web to the core tube in said roller bed and means for severing the fully wound roll ejected from said roller bed from the attached web start, said first pivot axis lying at a distance from and parallel to the axis of rotation of said support rollers whereby the path of travel of the attaching and severing means about said first pivot axis is such that the attaching and severing means engages each core tube inserted into said roller bed at the apex of the core tube irrespective of its diameter.

2. A winding machine according to claim 1, wherein said attaching and severing means further comprising first and second lever arms mounted for pivotal movement about said first axis which lies adjacent to the support roller around which the incoming web is wrapped in a plane which extends parallel to the common axial plane of the support rollers and through a point approximately halfway between the apexes of the largest and smallest diameter core tubes which the machine can handle.

3. A winding machine according to claim 1, wherein the effective length of said first and second lever arms is between 0.5 times and 3 times the distance between the axes of rotation of the support rollers.

* * * * *